US005454215A

United States Patent [19]

Martelli

[11] Patent Number: 5,454,215

[45] Date of Patent: Oct. 3, 1995

[54] CASE GRIPPING DEVICE IN AN AUTOMATIC PACKAGING MACHINE

[75] Inventor: Guglielmo Martelli, Loddington, United Kingdom

[73] Assignee: A.M.R.P. Handels AG, Basel, Switzerland

[21] Appl. No.: 45,510

[22] Filed: Apr. 8, 1993

[30] Foreign Application Priority Data

Apr. 14, 1992 [IT] Italy ..... B092A0135

[51] Int. Cl.[6] ..... B65B 43/46

[52] U.S. Cl. ..... 53/564; 53/53; 269/57; 193/318; 193/319; 198/475.1

[58] Field of Search ..... 53/53, 564, 566; 493/315, 318, 319; 198/470.1, 475.1; 269/56, 57

[56] References Cited

U.S. PATENT DOCUMENTS

| | | | |
|---|---|---|---|
| 1,275,759 | 8/1918 | Russell | 493/319 |
| 1,873,059 | 8/1932 | Smith et al. | 53/73 |
| 3,378,128 | 4/1968 | Stevenson, Jr. et al. | 493/319 |
| 3,527,477 | 6/1970 | Thornton | 53/53 |
| 4,642,975 | 2/1987 | Langen et al. | 53/564 |
| 4,891,928 | 1/1990 | James et al. | 53/564 |
| 5,155,968 | 10/1992 | Mosse et al. | 53/564 |
| 5,215,515 | 6/1993 | Bershadsky | 493/318 |

FOREIGN PATENT DOCUMENTS

| | | |
|---|---|---|
| 1198891 | 4/1959 | France . |
| 338212 | 7/1930 | United Kingdom . |

*Primary Examiner*—W. Donald Bray
*Attorney, Agent, or Firm*—McAulay Fisher Nissen Goldberg & Kiel

[57] ABSTRACT

A gripping device for cases is mounted in an automatic packaging machine and includes a pair of stationary prongs and an associated pair of counterfacing prongs which cooperate to clamp a case between them. At least the movable prongs have notchings facing the stationary prongs which are adapted to grip a side wall panel of the case.

3 Claims, 3 Drawing Sheets

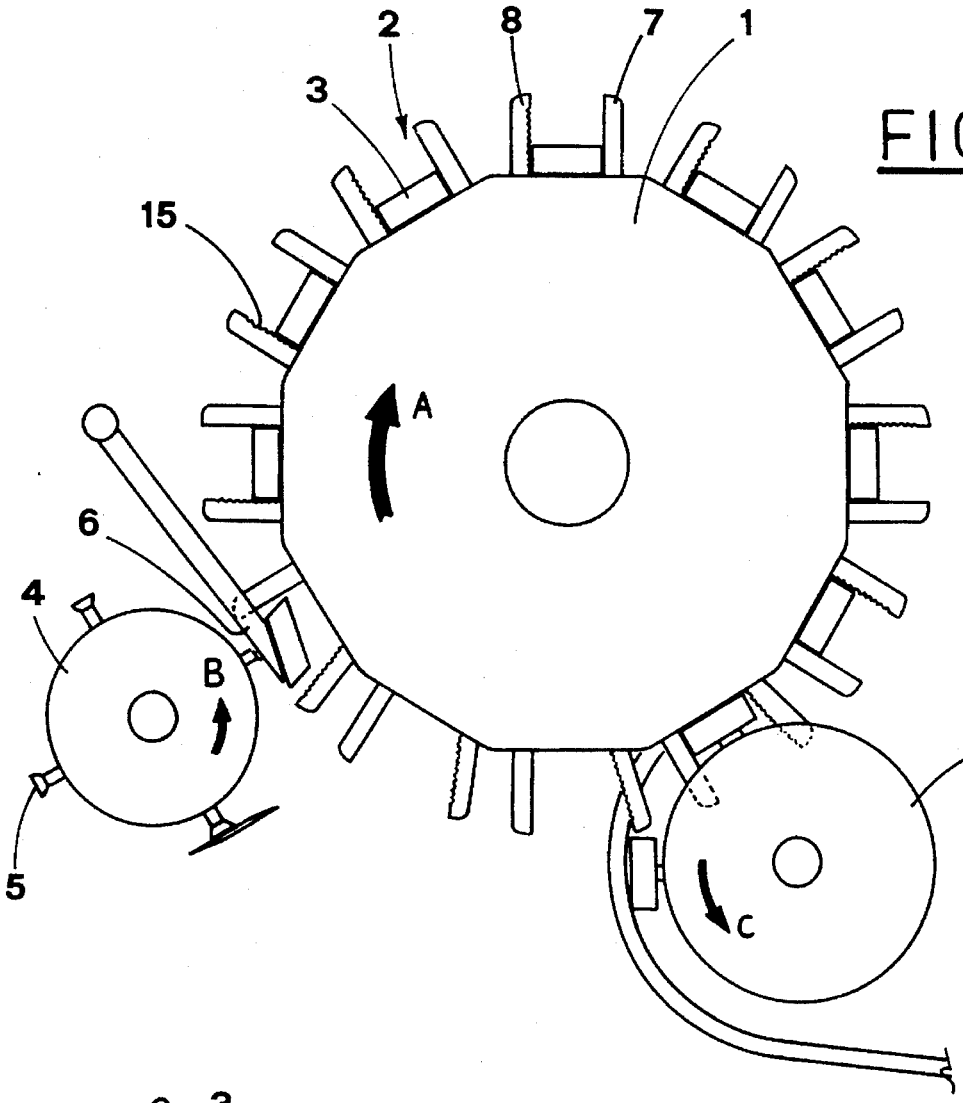
FIG. 1
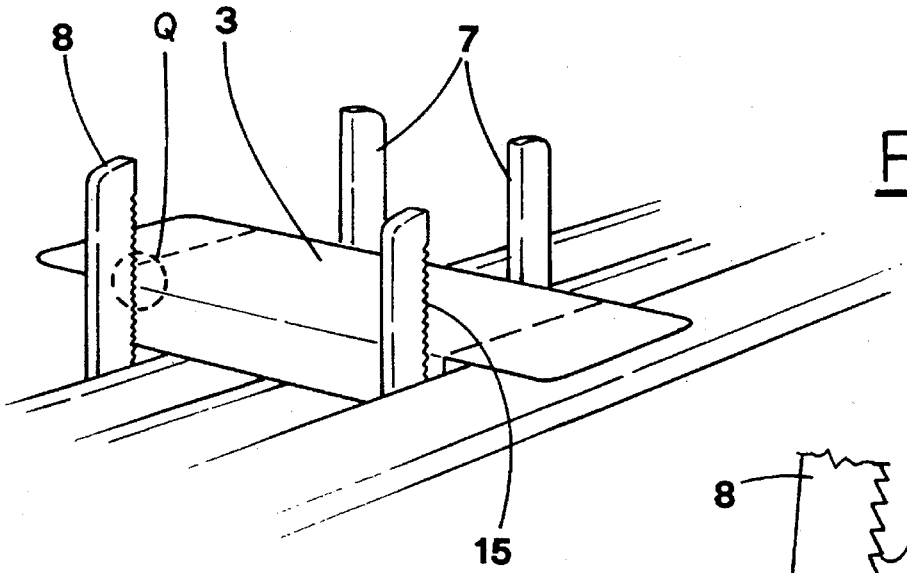
FIG. 5
FIG. 6
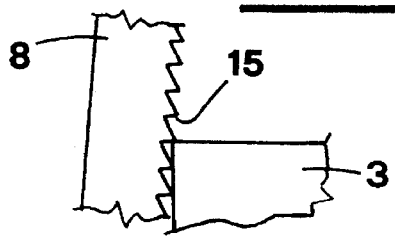

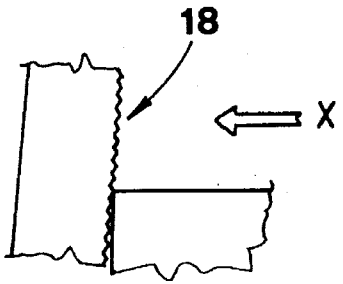
FIG. 9
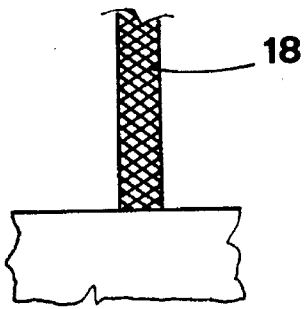
FIG. 10
FIG. 7
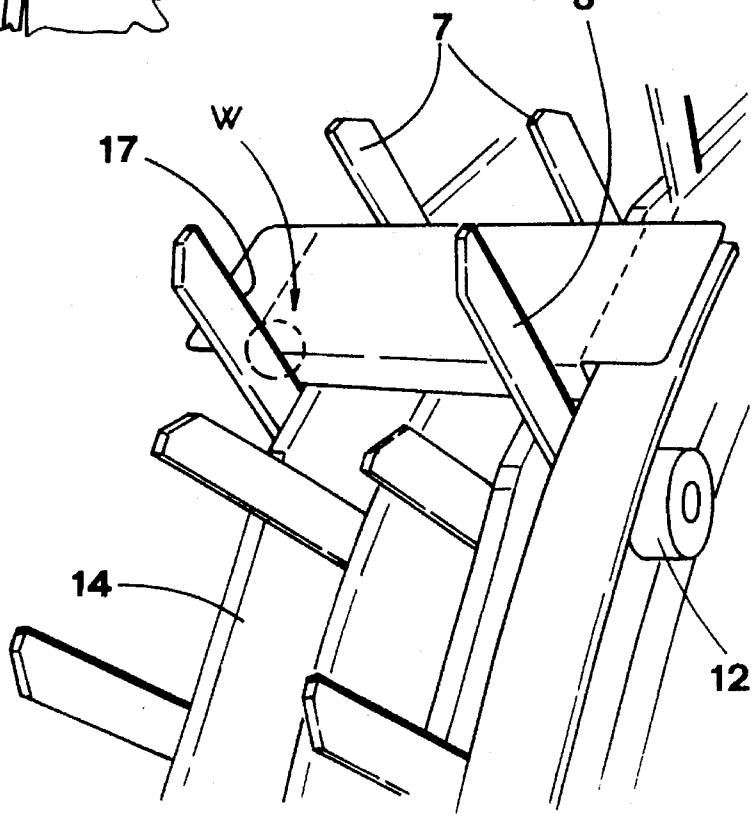
FIG. 8
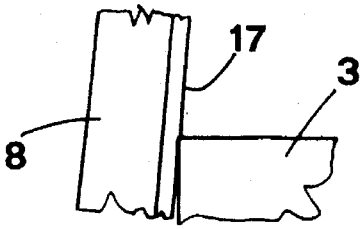

CASE GRIPPING DEVICE IN AN AUTOMATIC PACKAGING MACHINE

BACKGROUND OF THE INVENTION

The present invention relates to the technical field concerned with the manufacturing of packaging machines for various articles.

DESCRIPTION OF THE PRIOR ART

Many machines are presently known which erect a case from a respective blank and then fill the case with articles to be packed.

One of these machines has a turntable fitted with gripping means regularly spaced out along its periphery and consisting of prongs, which are adapted to take over the cases coming from a storage magazine where the blanks for making the cases are arranged in flat-folded condition.

Suitable means cooperate with the gripping means to erect and form the cases.

Further means operate in a subsequent station for inserting the articles into the case and for closing the case such that, finally, the filled case is brought along to a further section of the packaging line.

In another known packaging machine the gripping means are supported by suitable endless means, such as chains, and moved in a straight path along which the cases are completed, filled and closed as described above.

In all these machines there is the problem that the cases can move sidewards during transportation, thus taking a position that is not a correct one, and escaping from the gripping means.

To solve this problem in the machine equipped with the turntable there is provided a guard means made in form of a curved bar and supported by a cantilevered arm, so that it follows sidewise the path of the cases.

In the straight type packaging machine this guard means extends parallel to the transporting section of the packaging line, that is formed by the endless means.

It is clear that since the dimensions, particularly the height of the cases, are frequently changed, it is also necessary to adjust the position of the guard means in accordance with the new size of the cases, and this is made by changing the distance between the guard means and the surface upon which the cases rest.

Particularly, in the machine equipped with the turntable it is necessary to replace the guard bar because changing this distance requires changing also the curve radius of the bar.

Therefor it is necessary to provide a complete series of guard bars each one with a different curve radius for each size of cases.

In any event, the machine must be stopped for a certain time and specialized personnel are required for the adjustment, with high cost and a decrease in production.

The machine must also be stopped when a case jams, since otherwise it would be rather difficult to work on such machine.

SUMMARY OF THE INVENTION

The object of the present invention is to propose a device designed to be mounted in an automatic packaging machine and that is able to perform a safe clamping of cases having different sizes.

This object is achieved through a case gripping device mounted in an automatic packaging machine, that comprises a pair of stationary prongs and a pair of movable prongs, the movable prongs being counterfacing to said pair of stationary prongs.

The pairs of stationary and movable prongs cooperate with each other to clamp a case between them, and each prong of at least one pair of the pairs of stationary and movable prongs has a surface pushing on a side wall panel of the case, that features engaging means.

BRIEF DESCRIPTION OF THE DRAWINGS

The main features of the invention are set out in the following, with particular reference to the accompanying drawings, in which:

FIG. 1 is a schematic side view of a packaging machine equipped with a turntable;

FIG. 5 is a perspective view of the gripping device mounted on a straight packaging machine;

FIG. 6 is an enlarged view of particular Q of FIG. 5;

FIG. 7 is a perspective view of another embodiment of the gripping device, mounted on a packaging machine equipped with a turntable;

FIG. 8 is an enlarged view of particular W of FIG. 7;

FIG. 9 is an enlarged view of the same particular W shown in FIG. 8, but concerning another embodiment of the invention;

FIG. 10 is an enlarged view of the particular shown in FIG. 9 seen as indicated by the arrow X.

DESCRIPTION OF THE PREFERRED EMBODIMENT

Figure 3:
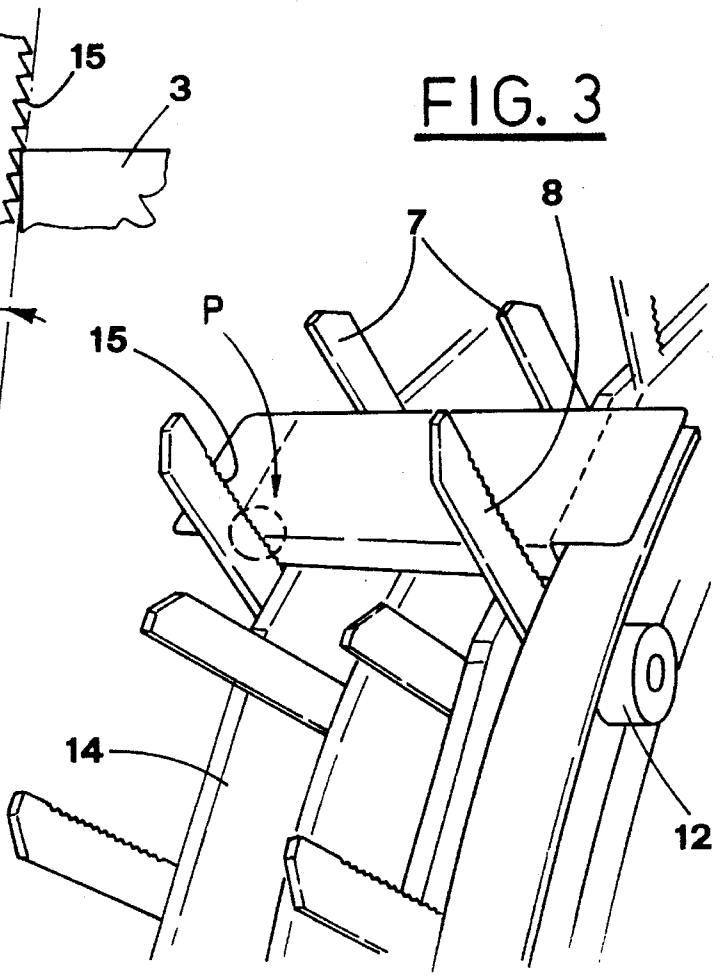
FIG. 3 is a further perspective view of the gripping device.

Referring to the above quoted figures, reference numeral 1 indicates the turntable of an automatic packaging machine, that is made to rotate in accordance with the direction indicated by the arrow A.

The turntable 1 is equipped with gripping means 2 that are equi-spaced and mounted along its peripheral outline.

The gripping means are adapted to take sleeve type cases 3 which are withdrawn from a storage magazine wherein they are stored in a flat-folded condition.

The cases 3 are fed, intermittently and in synchrony with the rotation of the turntable 1, by a rotary supply member 4 that rotates in accordance with the direction indicated by the arrow B.

The supply member 4 is equipped with suction cup means 5 mounted along its circumference for transferring the flat-folded cases 3.

The transferring is completed by a member 6 that engages one of the wall panels of the cases 3.

When a case 3 is opened, then it is kept in this shape by the gripping means of the turntable 1.

The gripping means comprise a first pair of prongs 7, which are stationary, and a second pair of prongs 8, which are movable.

The two pairs of prongs are mounted counterfacing to each other, and cooperate for clamping a case 3 between them.

More particularly, the movable prongs 8 are made integral with respective swinging arms 9 which pivot upon a pin 11 parallel to the rotation axis of the turntable.

Springs 10 are hooked to the turntable and to each arm 9 respectively.

Figure 2:
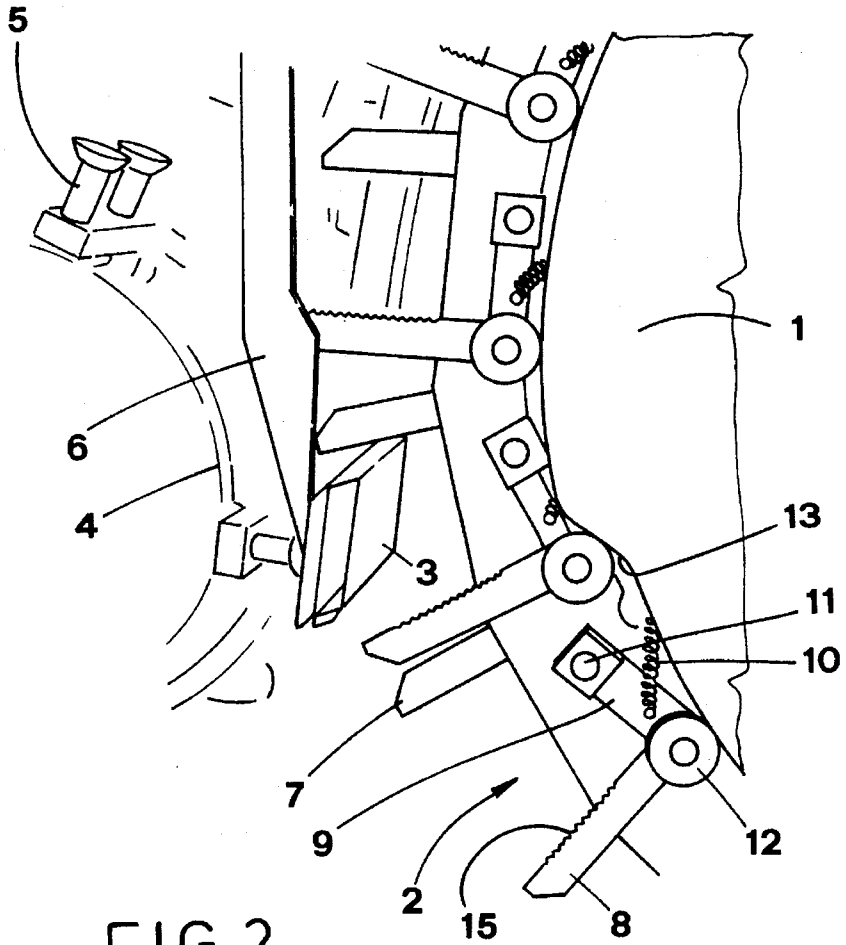
FIG. 2 is a perspective view of the gripping device that is the subject of the present invention.

The end of each movable prong 8 that is connected to the related arm 9, supports an idle roller 12, that engages a stationary cam 13 that has the task of controlling the opening and closing movements of the gripping means 2 (see FIG. 2).

The pins 11 are fixed to two plates 14 which define peripherally resting surfaces for the cases 3 taken over by the turntable 1.

In accordance with the present invention, each movable prong 8 features a notching 15, preferably shaped like a saw-tooth toothing, made on the side of the prong that engages the side wall panel of the case 3.

Figure 4:
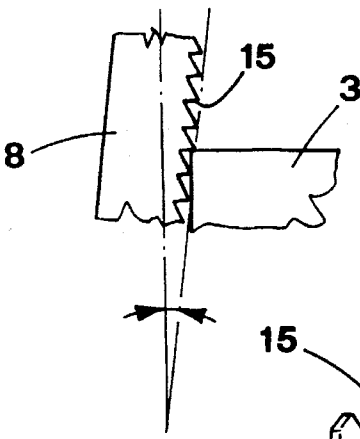
FIG. 4 is an enlarged view of particular P of FIG. 3.

While clamping a case, the movable prongs 8 are slightly bent foreward at an angle L, with reference to the motion direction, as it can be seen in FIG. 4, where the particular P of FIG. 3 is shown enlarged.

The cases 3 fed in a series by the supply member 4, are taken by the the pairs of prongs 7 and 8 of respective gripping means.

While receiving a case 3, the pairs of prongs 7 and 8 are slightly wide apart, so that the insertion of the case is made easier (see FIG. 2).

The movable prongs 8 are located after the stationary prongs with reference to the rotary motion A of the turntable, that is, they follow the stationary prongs at a datum point while the turntable rotates. While opening, the moveable prongs move in a direction opposite to the rotary motion A.

Therefore the movable prongs 8 clamp elastically the case 3, keeping this case in its unfolded box shape.

The cases 3 have opposed open ends for insertion of articles therein (see FIG. 3).

While clamping a case, the notching 15 acts on the side wall panel of the case 3 in such a way that a tooth engages the outer corner adjacent to the same wall panel.

This engagement is facilitated by the tendency of the case to resume the flat-folded condition.

Therefore, using the invention, there is no need for a peripheral guard bar in this machine to keep the cases in their unfolded box shape.

When the size of the cases is changed other teeth of the notching 15 engage with the cases 3, in a similar fashion.

The engagement is made easier because of the slight foreward bending of the movable jaws 8.

The device described herein provides for an automatic adjustment of the gripping means in accordance with the height of the cases 3 to be filled with articles, thus avoiding the necessity to stop the production each time that the size is changed, as it happens in the packaging machines equipped with conventional gripping devices.

In case one of the cases jams, it is possible to operate on this one only, without removing other cases.

When the articles are inserted in a case 3 and the closure flaps of the case are closed, then a rotary discharging member 16 takes over the case while rotating in accordance with the direction indicated by the arrow C.

FIG. 5 shows the working of the gripping device mounted on a straight packaging machine.

In this case the prongs of the gripping means are supported, in a known manner, by suitable chain means which are not shown.

FIGS. 7 and 8 show another embodiment of the gripping means, wherein each of the movable prongs 8 is provided with a strip 17 of high friction material adhesively applied to the side of the prong that moves to push on the side wall panel of the case 3.

The strip 17 is adhesively applied to the prong in a proper way.

The task of the strip 17 is obviously the same as that of the notching 15 described above.

FIGS. 9 and 10, finally, show a knurling 18 made on the prongs 8 in order to make possible the engagement with the case.

What is claimed is:

1. A case gripping device for an automatic packaging machine, the device comprising a pair of stationary prongs and a pair of moveable prongs, said movable prongs and stationary prongs cooperating with each other to clamp a case between them, at least one prong of a pair of prongs having a saw tooth notched surface on a side thereof for engaging a side wall panel of said case.

2. A case gripping device for an automatic packaging machine, the device comprising a pair of stationary prongs and a pair of movable prongs, said moveable prongs and stationary prongs cooperating with each other to clamp a case between them, at least one prong of a pair of prongs having a high friction material on a side thereof for engaging a sidewall panel of said case.

3. A case gripping device for an automatic packaging machine, the device comprising a pair of stationary prongs and a pair of movable prongs, said movable prongs and stationary prongs cooperating with each other to clamp a case between them, at least one prong of a pair of prongs having a knurled surface on a side thereof for engaging a sidewall panel of said case.

* * * * *